US006543864B2

(12) United States Patent
Cline

(10) Patent No.: US 6,543,864 B2
(45) Date of Patent: Apr. 8, 2003

(54) DUST COVER FOR SHELVING UNIT

(76) Inventor: William Cline, 5763 Clearview, Troy, MI (US) 48098

( * ) Notice: Subject to any disclaimer, the term of this patent is extended or adjusted under 35 U.S.C. 154(b) by 0 days.

(21) Appl. No.: 09/816,724

(22) Filed: Mar. 21, 2001

(65) Prior Publication Data

US 2002/0135278 A1 Sep. 26, 2002

(51) Int. Cl.[7] ..... E04H 15/34

(52) U.S. Cl. ..... 312/3; 52/3; 52/202; 150/165; 428/99

(58) Field of Search ..... 312/3, 6, 228; 52/3, 202; 150/154, 160, 165; 428/100, 99; 211/180

(56) References Cited

U.S. PATENT DOCUMENTS 2,711,769 A 6/1955 Katcher et al.
3,746,151 A * 7/1973 Brophy et al. ..... 312/3
4,244,411 A 1/1981 Karlström et al.
4,948,154 A * 8/1990 Guggenheim ..... 211/180 X
4,954,384 A 9/1990 Hartwell
D313,143 S * 12/1990 Handler et al. ..... 108/149 X
5,192,092 A 3/1993 DiBenedetto
5,474,185 A 12/1995 Franke
5,694,866 A 12/1997 Muller

* cited by examiner

*Primary Examiner*—John G. Weiss
*Assistant Examiner*—Michael J. Fisher
(74) *Attorney, Agent, or Firm*—Young & Basile P.C.

(57) ABSTRACT

A plastic dust cover for upright freestanding metal shelving units. The dust cover comprises integral top panel, side panels and rear panel together with vertically zippered front panels which are preferably transparent. A Velcro closure system is provided for securing the top of the front panel. Magnets are sewn into the bottom edges of the front panels to cause them to adhere to the bottom front of the shelving unit.

5 Claims, 3 Drawing Sheets

DUST COVER FOR SHELVING UNIT

FIELD OF THE INVENTION

This invention relates to dust covers for upright shelving units of the type having a top and opposed parallel sides with vertically spaced horizontal shelves extending therebetween. More particularly the invention relates to a dust cover for shelving units of the type described which permits the user to view the contents of the shelving unit through the dust cover as well as to access the content by selectively opening the left or right sides of the cover.

BACKGROUND OF THE INVENTION

Upright freestanding shelving units are commonly used in industrial areas to store documents or books in binders on vertically spaced horizontal shelves. It is typical for at least the front of such shelving units to be open to permit viewing of the materials on the shelves as well as to provide access to such materials as needed.

Where such shelving units are used in a dusty or grimy environment, the documents, books or other materials stored on the shelves become soiled and require cleaning at regular or irregular intervals to preserve such documents, books or materials for use over a reasonably long period of time.

SUMMARY OF THE INVENTION

The present invention is a dust cover for upright, free-standing shelving units of the type having a top, opposed vertical sides and a number of vertically spaced horizontal shelves extending therebetween. The dust cover which is described as a preferred and specific embodiment of the invention contemplates use with a metal shelving unit which is closed at the rear but it will be understood that the dust cover of the present invention may also be used with shelving units made of wood or plastic and with shelving units which are open both front and rear and even partially open on the, sides.

In general the dust cover in the present invention comprises a "slip over" unit having integral top and side panels of opaque, non-porous material which are adapted to overlie the top and sides of the shelving unit. The cover further comprises a pair of reversely symmetrical front panels of substantially transparent, non-porous, pliable material such as plastic attached to the side panels to form vertical seams which, when the dust cover is in use, overlie and extend along the front vertical edges of the shelving unit. Further the unit comprises a vertical zipper having opposed tracks attached to and extending along the inner vertical edges of the front panels so as to open and close the dust cover from the front. Preferably the zipper is of the bidirectional type so that the unit may be opened from either the top or bottom.

Finally the unit comprises structures such as hook and loop type fastener or magnets arranged along the top and bottom horizontal edges of the front panels to removably adhere those panels to the top and bottom front edges of the shelving unit.

The dust cover of the present invention may have a full or partial rear panel or may be of the two sided type wherein both front and rear portions are provided with reversely symmetrical zippered panels of the type described above.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENTS

Figure 1:
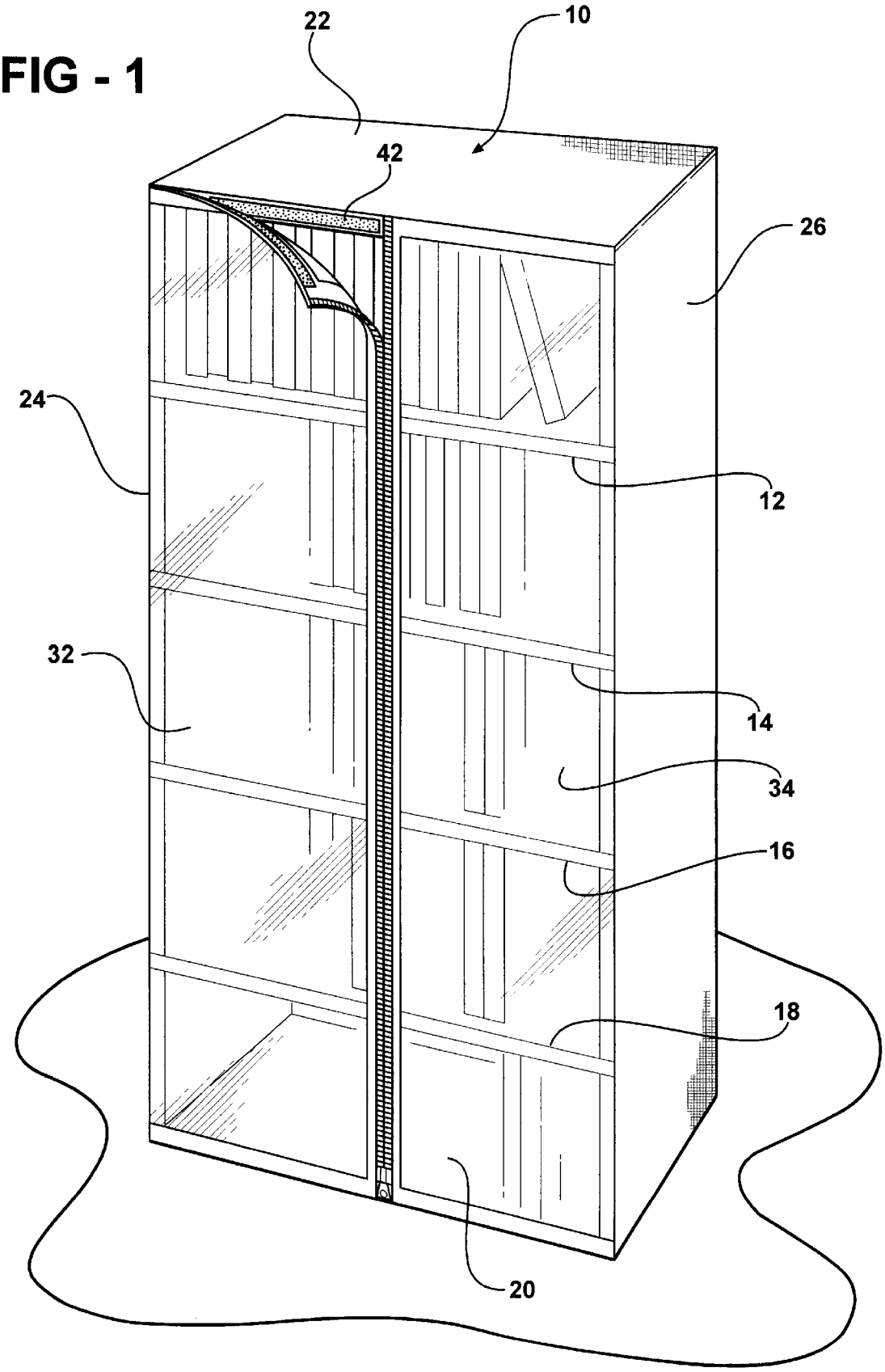
FIG. 1 is a perspective view of a dust cover embodying the present invention installed on a vertical upright free-standing metal shelving unit having five shelves.

Referring now to the drawings, a slip over dust cover 10 of dust-impermeable plastic material is shown in combination with an upright freestanding metal shelving unit of the type having a flat horizontal top, opposed parallel sides and vertically spaced horizontal shelves 12, 14, 16 and 18 extending therebetween and suitably attached thereto. The shelving unit further comprises a base 20 which also serves as a bottom shelf. This particular shelving unit is made of steel and has a fully closed rear panel but it is to be understood that a shelving unit having an open rear can also be accommodated. Moreover, it will be apparent from the following description that a shelving unit with partially open sides can also be used with the present invention.

The dust cover 10 comprises integral top panel 22 and side panels 24 and 26 which, when the dust cover is fully assembled and placed over the shelving unit, overlie the top and side exterior surfaces of the shelving unit. In the embodiment shown in the figures, the top panel 22 and side panels 24 and 26 along with a rear panel 28 are cut from a single sheet of material. Thereafter the opposite edges of the rear panel 28 are stitched, bonded, heat welded or otherwise joined to the rear edges of the side panels 24 and 26 in any of a variety of known ways to integrate the panels into the configuration and structure essentially shown in FIG. 1. Although a full rear panel 28 as shown, it will be understood to cross straps and/or a partial rear panel may be substituted. The material may be 70 Denier nylon.

The dust cover 10 further comprises a pair of reversely symmetrical front panels 32 and 34 of transparent plastic material. Opaque borders 36 and 38 are preferably added to the front panels 32 and 34 for strength as well as aesthetic purposes. A zipper 40 is attached to and extends along the inside horizontal edges of the front panels 32 and 34 to permit those panels to be joined together and/or to be unzipped to the desired extent. Preferably the zipper has tracks and travelers which permit the zipper to be open from both the top and the bottom.

The front panels 32 and 34 are joined by stitching, bonding or heat welding along the outside vertical edges to the front vertical edges of the side panels 24 and 26 to integrate those front panels with the side panels in any of a number of known ways.

Figure 3:
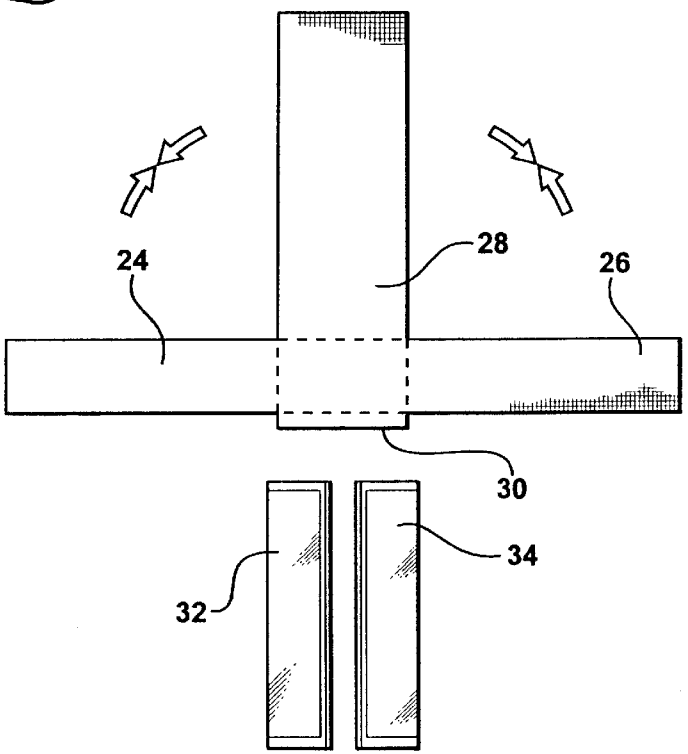
FIG. 3 is a plan view of the pattern of FIG. 2.
Figure 2:
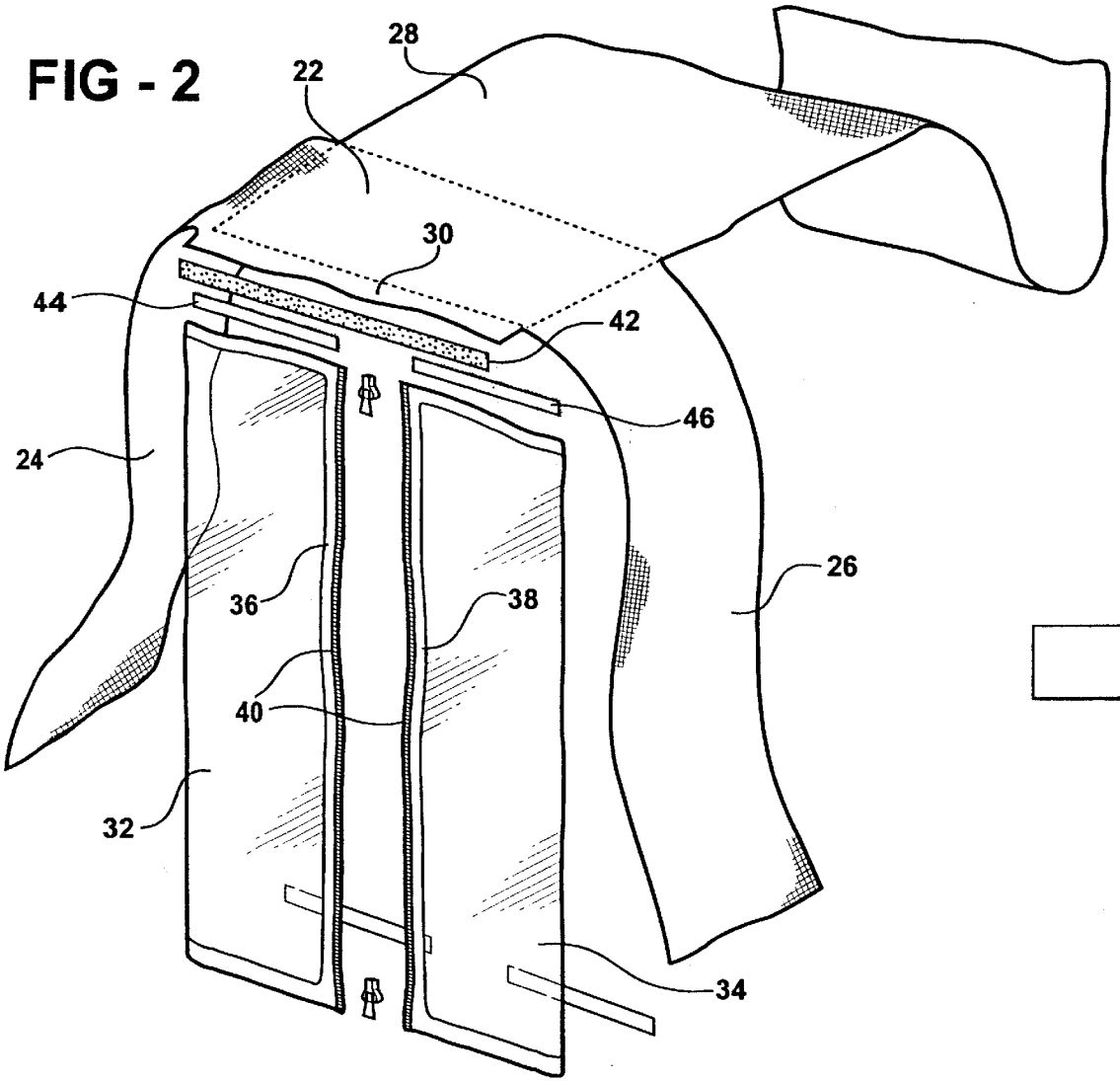
FIG. 2 is a perspective view of the dust cover of FIG. 1 in an exploded view.
Figure 5:
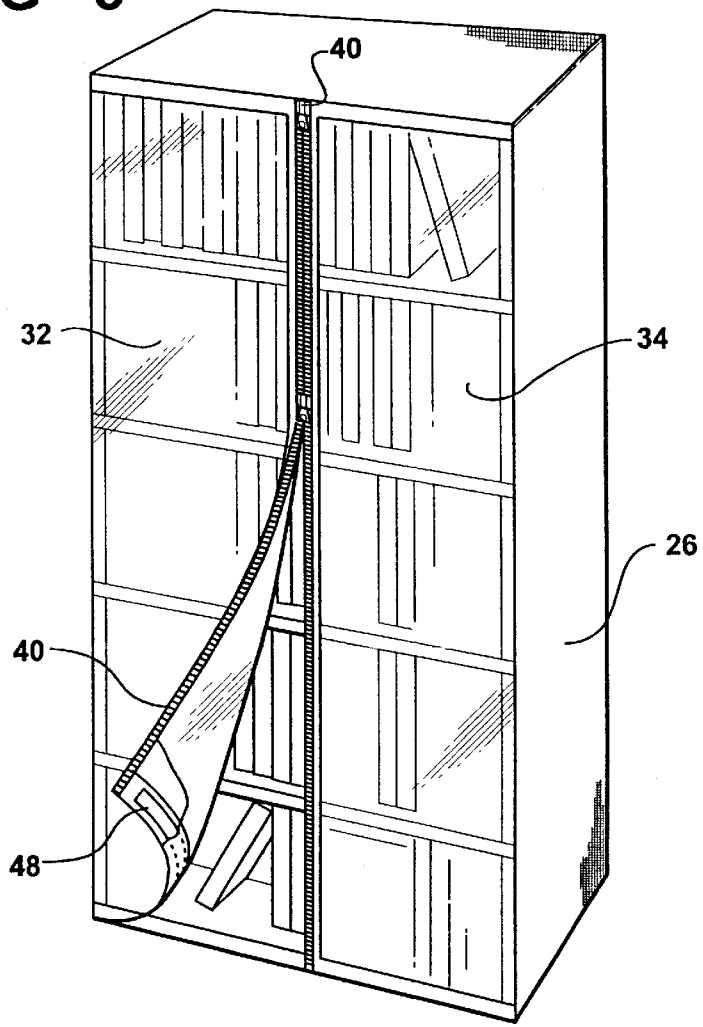
FIG. 5 is a perspective view of the arrangement of FIG. 1 with the left front panel of the dust cover partially open from the bottom.

It will be observed in FIGS. 2 and 3 that the top panel 22 is cut slightly larger than the top of the shelving unit so as to create a flap 30 which folds down and overlies the front edge surface of the shelving unit. A Velcro strip 42 is preferably stitched or otherwise attached to the outside surface of the flap 30 to cooperate with Velcro type strips 44 and 46 which are attached by suitable means to the inside top edges of the front panels 32 and 34.

Accordingly the front panels 32 and 34 may be removably adhered to the top edge of the top panel 22; i.e., to the flap 30 which extends over the front vertical edge of the shelving unit.

Figure 4:
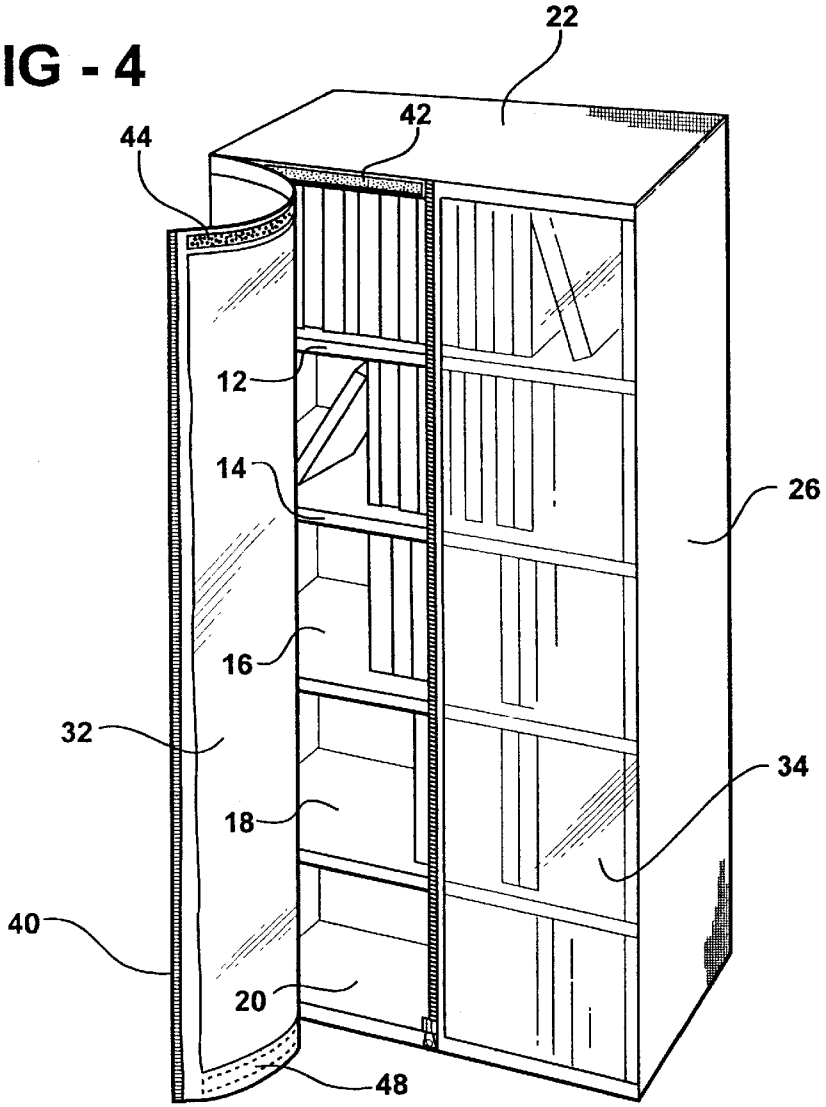
FIG. 4 is a perspective view of the arrangement of FIG. 1 with the left front panel of the dust cover opened.

In the case of a dust cover which is used in combination with a steel shelving unit, magnets 48 are sewn into the bottom of the front panel as shown in FIG. 4 to cause those panels to removably adhere to the front bottom edge of the shelving unit base 20.

Of course magnets are not feasible for shelving units made entirely of wood or plastic. I these cases, a relatively dust-proof seal along the bottom of the front panels 32 and 34 can be achieved by providing a strip of material across the lower edge of the cover extending between and attached to the edges of the side panels 24 and 26 by stitching or the like. Outward-facing Velcro can be attached to this strip and inward-facing Velcro to the panels 32 and 34 along the bottom edges similar to the arrangement 42, 44 and 46 at the top. Because such a strip makes installation of the cover more difficult, it is preferred to split the strap into left ad right portions and provide a sturdy snap fastener to permit them to be joined after installation of the cover on the shelving unit.

In operation one slips the dust cover 10 over the free-standing upright shelving unit such that the top panel 22 of the dust cover overlies and conforms to the top of the shelving unit and the side panels 22 and 24 conform to and overlie the sides of the shelving unit. The dust cover 10 may be fully closed by the zipper 40 and the top and bottom closures as previously described.

When one wishes to gain access to the documents or other materials which are stored on the shelves of the shelving unit, one can readily view those of those items through the transparent panels 32 and 34 and thereafter open either left or right panels 32 and 34 or both panels as necessary. Moreover the panels may be selectively opened from the top or the bottom or entirely opened as generally shown in FIG. 4.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A bottomless slip-over dust cover for an upright metal shelving unit of the type having a top and opposed parallel sides with vertically spaced horizontal shelves including a base shelf panel extending therebetween, said cover comprising:

integral top and side panels of opaque non-porous material adapted to overlie and generally conform to the top and sides of said shelving unit;

a pair of reversely symmetrical front panels of substantially transparent non-porous material attached to said side panels along the front vertical edges of said unit;

a vertical zipper having opposed tracks attached to the inner vertical edges of said front panels to provide a center opening;

a first attachment structure for providing a dust seal along the top edges of the front panels; and a second attachment structure along the bottom edge of the front panel for providing a dust seal between the bottom edges of the front panel and the base shelf panel.

2. A dust cover as described in claim 1 wherein the opaque material and the substantially transparent material are plastic.

3. The dust cover as described in claim 1 wherein the top attachment structure is of the hook and loop attachment type.

4. The dust cover as described in claim 1 wherein the bottom attachment structure is magnetic.

5. The dust cover as described in claim 1 further including an integral rear panel extending between the side panels.

* * * * *